US009803943B2

(12) United States Patent
Schafer et al.

(10) Patent No.: US 9,803,943 B2
(45) Date of Patent: Oct. 31, 2017

(54) FIREARM MAGAZINE GUIDANCE AND EJECTION DEVICE

(71) Applicant: Iron Claw Tactical LLC, Tigerton, WI (US)

(72) Inventors: John Schafer, Arlington Heights, IL (US); Maura Schafer, Arlington Heights, IL (US); Louis Papamihail, Bloomingdale, IL (US)

(73) Assignee: Iron Claw Tactical LLC, Tigerton, WI (US)

( * ) Notice: Subject to any disclaimer, the term of this patent is extended or adjusted under 35 U.S.C. 154(b) by 0 days.

(21) Appl. No.: 15/061,357

(22) Filed: Mar. 4, 2016

(65) Prior Publication Data

US 2016/0258700 A1 Sep. 8, 2016

Related U.S. Application Data

(60) Provisional application No. 62/129,249, filed on Mar. 6, 2015.

(51) Int. Cl.
*F41A 9/59* (2006.01)
*F41A 17/38* (2006.01)
*F41A 3/66* (2006.01)

(52) U.S. Cl.
CPC ..... *F41A 17/38* (2013.01); *F41A 3/66* (2013.01); *F41A 9/59* (2013.01)

(58) Field of Classification Search
CPC ..... F41A 9/59; F41A 17/38
See application file for complete search history.

(56) References Cited

U.S. PATENT DOCUMENTS

| | | | | |
|---|---|---|---|---|
| 2,348,790 | A * | 5/1944 | de Kiraly et al. | F41A 3/56 89/152 |
| 2,594,237 | A | 4/1952 | Wallenhorst | |
| 2,636,302 | A | 4/1953 | Mulno | |
| 4,768,301 | A | 9/1988 | Thomas | |
| 5,899,013 | A | 5/1999 | Hauser et al. | |
| 7,219,462 | B2 | 5/2007 | Finn | |
| 7,823,312 | B2 | 11/2010 | Faifer | |
| 8,104,209 | B1 * | 1/2012 | Bentley | F41A 9/59 42/49.01 |
| 8,434,253 | B2 | 5/2013 | Cain et al. | |
| 8,683,725 | B2 | 4/2014 | Munson | |
| 8,726,554 | B2 | 5/2014 | Klassen | |
| 9,513,077 | B2 * | 12/2016 | Noro | F41A 17/38 |
| 2006/0265925 | A1 | 11/2006 | Murello | |
| 2011/0232148 | A1 * | 9/2011 | Cain | F41A 17/38 42/6 |
| 2013/0269231 | A1 | 10/2013 | Pietrzyk | |
| 2014/0165440 | A1 | 6/2014 | Mayerl | |
| 2014/0325886 | A1 | 11/2014 | Mather | |
| 2016/0069628 | A1 * | 3/2016 | Fluhr | F41A 17/38 42/6 |

* cited by examiner

*Primary Examiner* — Stephen M Johnson
(74) *Attorney, Agent, or Firm* — Vedder Price P.C.

(57) ABSTRACT

A firearm magazine guard unit including an attachment unit affixed to the firearm magazine guard unit, a magazine ejection unit rotatively affixed to the firearm magazine guard unit, where a portion of the magazine ejection unit is in contact with the magazine when the magazine is inserted into the firearm magazine guard unit.

9 Claims, 5 Drawing Sheets

FIREARM MAGAZINE GUIDANCE AND EJECTION DEVICE

CROSS-REFERENCE TO RELATED APPLICATIONS

This application is a non-provisional patent application that claims the benefit of and the priority from U.S. Provisional Patent Application No. 62/129,249, filed Mar. 6, 2015, titled FIREARM MAGAZINE GUIDANCE AND EJECTION DEVICE.

BACKGROUND OF THE INVENTION

With the growing popularity of shooting sports, more people are purchasing and firing weapons for recreational purposes. Many of the guns purchase for recreational shooting are older model firearms designed for more experienced users. One of the challenges for novice gunmen is the ability to properly insert a magazine containing ammunition into the receiving portion of a firearm, such as an assault rifle. A need exists for a device that will assist users in the assertion and ejection of an ammunition filled magazine from a firearm.

BRIEF SUMMARY OF THE INVENTION

One embodiment of the present disclosure includes a firearm magazine guard unit including an attachment unit affixed to the firearm magazine guard unit, a magazine ejection unit rotatively affixed to the firearm magazine guard unit, where a portion of the magazine ejection unit is in contact with the magazine when the magazine is inserted into the firearm magazine guard unit.

In another embodiment, the guard unit includes a cavity sized to accommodate the magazine.

In another embodiment, the magazine ejection unit is rotatively affixed to the magazine guard unit by a pin.

In another embodiment, the magazine ejection unit includes an ejection portion that is configured to engage the magazine in the magazine guard unit.

In another embodiment, the guard unit includes a trigger unit connected to the ejection portion.

In another embodiment, the guard unit includes a tab unit connected to the ejection portion.

In another embodiment, the guard unit includes a second attachment unit is removably affixed to at least one side of a firearm.

In another embodiment, the guard unit includes the second attachment unit is biased towards the magazine.

In another embodiment, the guard unit includes the second attachment unit moves away from the magazine when the magazine is removed from the guard unit.

In another embodiment, the guard unit includes a ridge that engages a portion of a firearm near a trigger guard on the firearm.

In another embodiment, the guard unit includes the ejection unit is rotatively affixed to the guard unit at a position along the length of the ejection portion.

In another embodiment, the guard unit includes the end of the ejection unit is angled from the horizontal by a predetermined angle.

In another embodiment, the guard unit includes the top surface of the tab includes a plurality of grooves.

In another embodiment, the guard unit includes the grooves are V shaped.

In another embodiment, the guard unit includes where a portion of the first attachment unit is in a cavity in the guard unit.

Another embodiment includes a firearm magazine guard unit including a first attachment unit rotatively affixed to the firearm magazine guard unit, a second attachment unit rotatively affixed to the firearm magazine guard unit, a magazine ejection unit rotatively affixed to the firearm magazine guard unit, where a portion of the magazine ejection unit is in contact with the magazine when the magazine is inserted into the firearm magazine guard unit.

BRIEF DESCRIPTION OF THE DRAWINGS

Details of the present invention, including non-limiting benefits and advantages, will become more readily apparent to those of ordinary skill in the relevant art after reviewing the following detailed description and accompanying drawings, wherein.

DETAILED DESCRIPTION OF THE INVENTION

While various embodiments of the present invention are described herein, it will be apparent to those of skill in the art that many more embodiments and implementations are possible that are within the scope of this invention. Accordingly, the present invention is not to be restricted except in light of the attached claims and their equivalents.

Described herein is a device for removably attaching a magazine to a firearm. The device includes a guide portion that is configured to guide an end of the magazine into a receiving portion of the magazine. A first attachment unit on one end of the device is configured to removably attach to the magazine when it is in the guide device. A second attachment unit is configured to attach to an underside of the firearm and a third attachment unit is configured to attach to the trigger guard of the firearm. A magazine releasing unit is rotatively attached to the device to allow for quick ejection of the magazine from the receiving portion of the gun.

Figure 1:
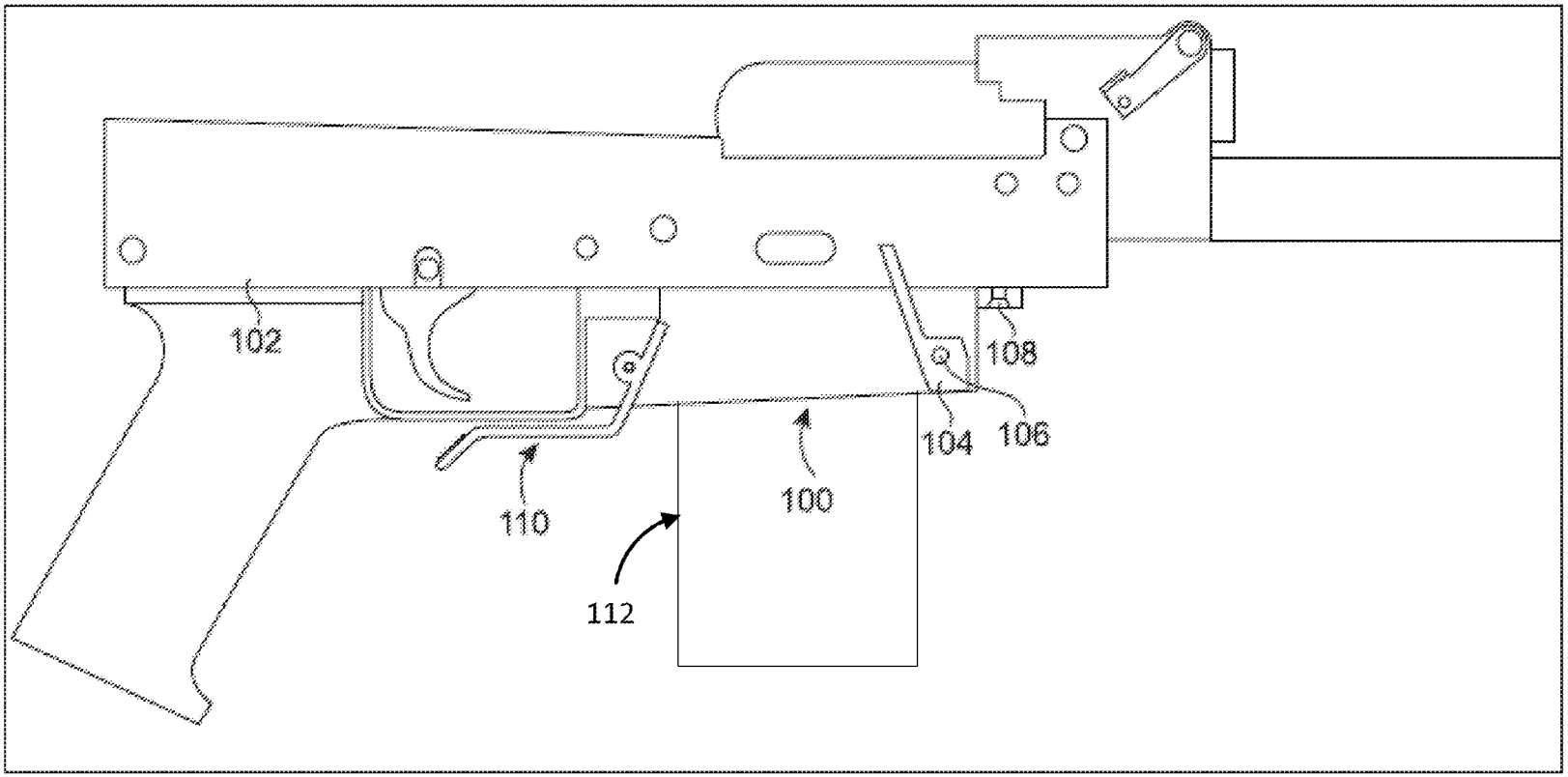
FIG. 1 depicts a magazine guide device attached to a firearm.

FIG. 1 depicts the magazine guide device 100 attached to a firearm 102. The magazine guide device 100 is removably attached to the firearm 102 by the first attachment unit 104. The first attachment unit 104 is rotatively attached to the magazine guide device 100 by a pin 106 with the pin 106 extending through an opening in the first attachment unit 104, a corresponding opening in the magazine guide device 100 and a second opening in the opposite side of the first attachment unit 104. A second attachment unit 108 extends from a portion of the magazine guide device 100 that is adjacent to a lower surface of the firearm 102 when the device 100 is affixed to the firearm 102. The attachment unit 108 may be a tab having an opening that is sized to accommodate a pin or screw. A magazine ejection unit 110 is rotatively affixed to the side of the device 100 closest to the trigger guard of the firearm 102. The magazine ejection unit 110 includes an ejection portion inside a cavity of the device 100 that is configured to engage a side surface of a magazine clip 112 such that the magazine clip 112 is forced away from the firearm 102 when the ejection unit 110 is rotated. In one embodiment, the first attachment unit 104 is omitted and the magazine guide device 100 is a connected to the firearm 102 by the attachment unit 108.

Figure 2:
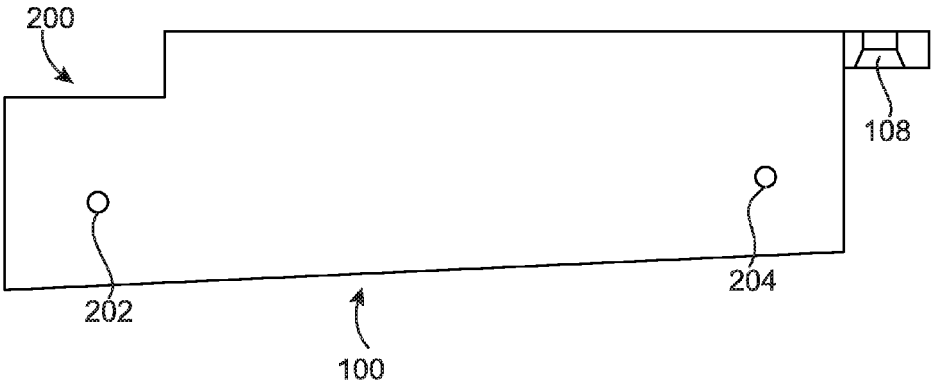
FIG. 2 depicts a side view of the magazine guide device of FIG. 1.

FIG. 2 depicts a side view of the magazine guide device 100. The magazine guide device 100 includes a ridge 200 that is configured to engage a portion of the firearm 102 near the trigger guard. In one embodiment, the ridge has a depth of approximately 0.75 inches and a height of approximately 0.30 inches. In another embodiment, the magazine guide device 100 has a height of approximately 1.25 inches on one end and a height of approximately 1.0625 inches on the opposing end. In one embodiment, the length of the magazine guide device 100 is approximately 4.2 inches.

An opening 202 is positioned on a side of the magazine guide device 100 near the ridge 200. The opening 202 is sized to accommodate a pin that engages the magazine ejection device 110. The opening corresponds to an opening on the trigger guard of the firearm such that the pin passing through the opening 202 also passes through the opening in the trigger guard. In one embodiment, the diameter of the opening 202 is approximately 0.197 inches and the opening 202 is positioned approximately 0.4375 inches from the side of the magazine guide device 100 closest to ridge 200. A second opening 204 is positioned on a side of the magazine guide device 100 opposite the ridge 200. In one embodiment, the second opening 204 has a diameter of 0.197 inches and is positioned 0.4375 inches from the side of the magazine guide device 100 furthest from the ridge 200.

Figure 3:
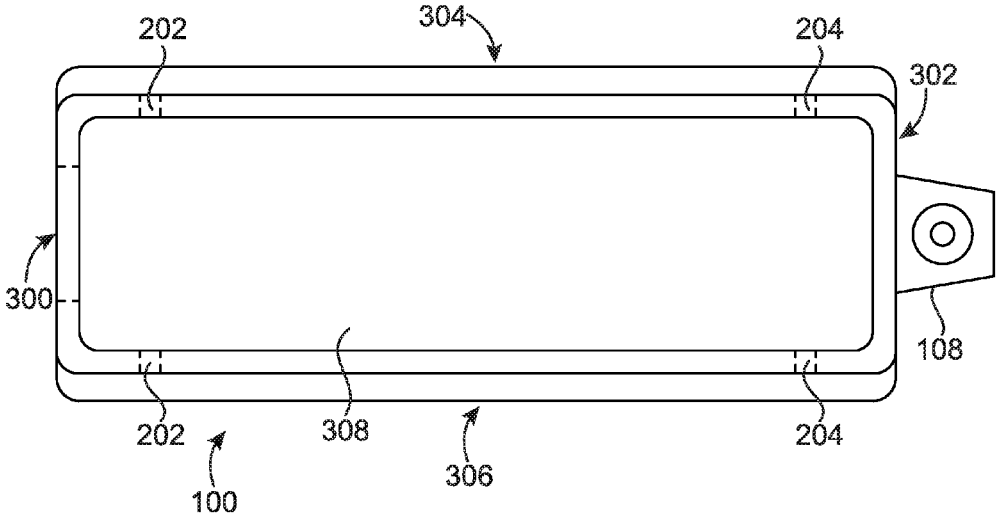
FIG. 3 depicts a bottom view of the magazine guide device of FIG. 2.

FIG. 3 depicts a bottom view of the magazine guide device 100. The magazine guide device 100 includes a first side 300 adjacent to the trigger guard of the firearm 102 when the device is affixed to the firearm 102, a second side 302, parallel to the first side 300, is separated from the first side 300 by a third side 304 that is substantially perpendicular to the first side 300 and second side 302, and a fourth side 306 extending between the first side 300 and second side 302 that is parallel to the third side 304. A cavity 308 is formed in the space between the first side 300, second side 302, third side 304 and fourth side 306. The cavity 308 is open on both ends to allow the magazine to pass completely through the device 100. The first opening 202 and second opening 204 extend through the third side 304 and fourth side 306 such that a pin can extend simultaneously through the third side 304 and fourth side 306 of the device 100.

Figure 4:
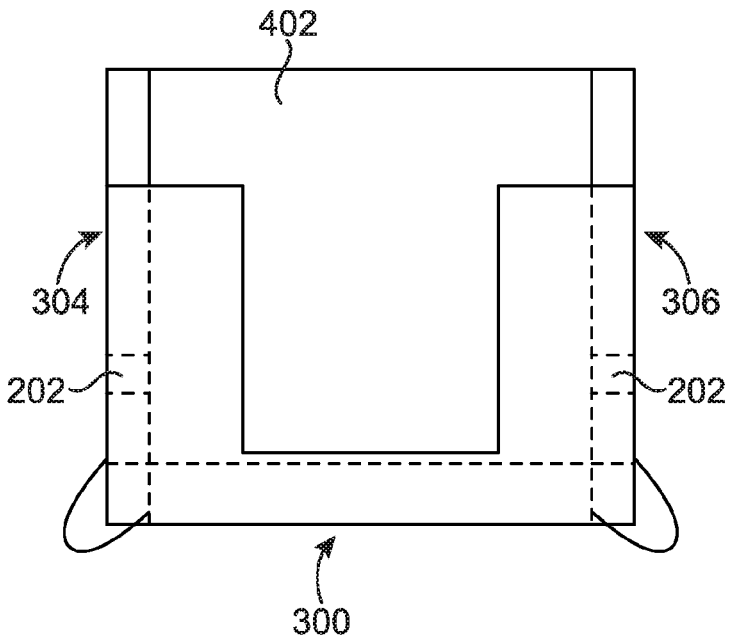
FIG. 4 depicts a side view of the magazine guide device of FIG. 1.

FIG. 4 shows a side view of the magazine guide device 100. A portion of the first side 300 is removed to form a "T" shaped portion 402. The "T" shaped portion 402 is sized such that the a lower portion (not shown) of the magazine ejection unit 110 engages the "T" shaped portion 402. When assembled, the magazine ejection unit 110 is rotatively affixed to the device by a pin that extends through opening 202 in the third side 304 and fourth side 306 of the device 100 and the lower portion of the magazine ejection unit 110.

Figure 5:
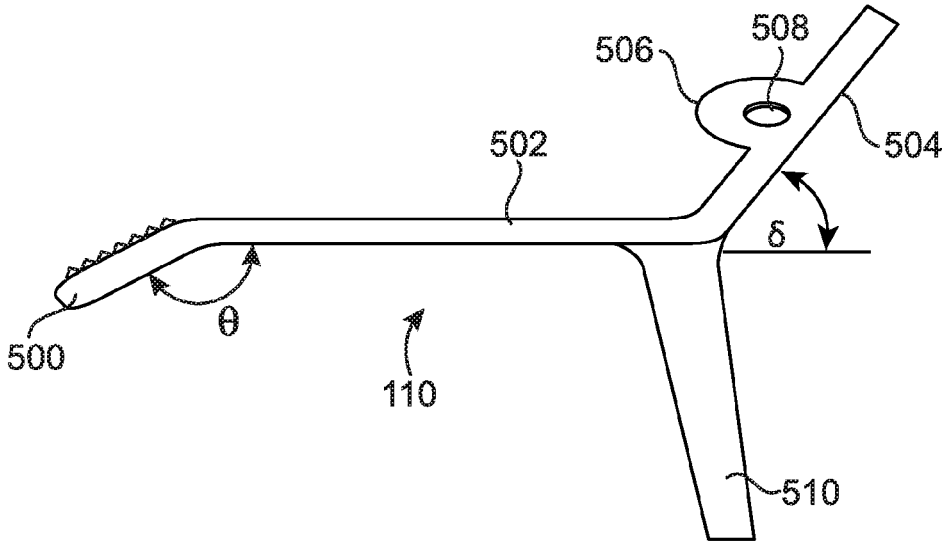
FIG. 5 depicts a side view of the magazine ejection unit of FIG. 1.

FIG. 5 depicts a side view of the magazine ejection unit 110. The magazine ejection unit 110 includes a tab 500 one end of the ejection unit 110, an extension portion 502 extending from one end of the tab 500, an ejection portion 504 extending from an end of the extension portion 502 opposite the tab 500 and a rotating portion 506 extending from a top surface of the ejection portion 504. The tab 500 is angled from the central axis of the extension portion 502 by an angle θ. In one embodiment, the angle θ is approximately 45 degrees. The ejection portion 504 extends from an end of the extension portion 502 furthest from the tab 500. The ejection portion 504 is angled from the central axis of the extension portion 502 by an angle δ. In one embodiment, the angle δ is approximately 20 degrees. The rotating portion 506 is positioned approximately halfway between the ends of the ejection portion 504. The rotating portion 506 includes an opening 508 that is configured to accommodate a pin. The rotating portion 506 is sized such that it fits into the "T" shaped portion 402 of the magazine guide device 100 with the opening 508 being substantially concentrically aligned with the central axis of the first openings 202 in the third and fourth sides 304 and 306 of the device 100. The end of the ejection portion 504 furthest from the tab 500 is angled from a horizontal axis by the same angle δ. A trigger unit 510 extends from the intersection of the extension portion 502 and the ejection portion 504. When a force is applied to the trigger unit 510 in a direction perpendicular the surface of the trigger unit 510, ejection unit 110 rotates around the opening 508.

In one embodiment, the rotating portion is substantially circular having a diameter of approximately 0.375 inches. In one embodiment, the distance from the center of the opening 508 to the end of the ejection portion 504 furthest from the tab is approximately 0.625 inches. In one embodiment, the rotating portion 506 extends from the ejection portion by approximately 0.375 inches. In one embodiment, the distance from an end of the tab 500 furthest from the rotating portion 504 to the end of the extension portion closest to the rotating portion 504 is approximately 1.90 inches. In one embodiment, the top surface of the tab 500 includes a plurality of V shaped grooves.

Figure 6:
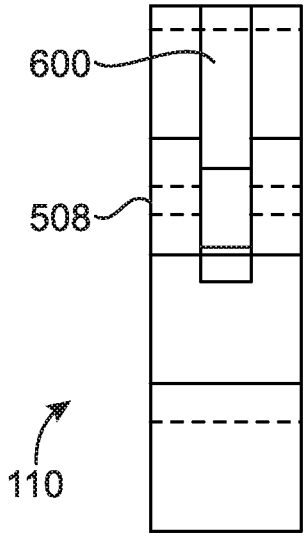
FIG. 6 depicts a front view of the magazine ejection unit of FIG. 5.

FIG. 6 depicts a front view of the magazine ejection unit 110. The opening 508 extends through the width of the magazine ejection unit 110. A central portion 600 of the ejection portion 404 is removed to form two parallel ejection portions 404.

Figure 7:
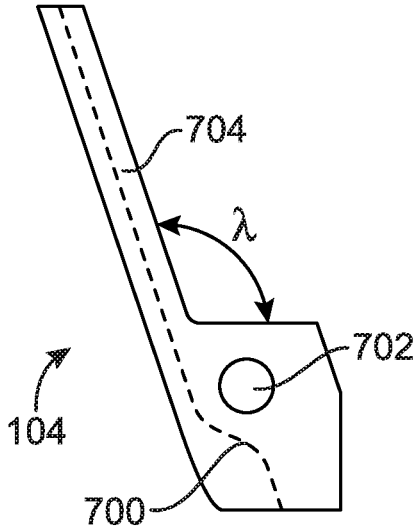
FIG. 7 depicts a side view of the first attachment unit of FIG. 1.
Figure 8:
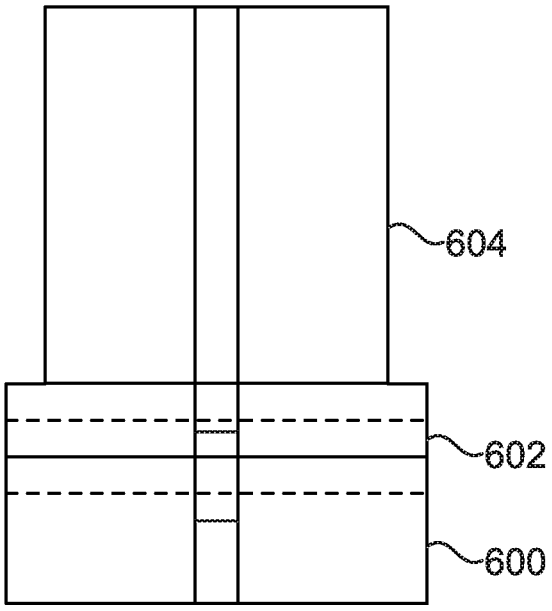
FIG. 8 depicts a front view of the first attachment device of FIG. 7.

FIG. 7 depicts a side view of the first attachment unit 104. The first attachment unit 104 includes a lower portion 700 that is sized such that the lower portion 700 fits into the cavity 308 of the device 100. An opening 702 in the lower portion 700 corresponds to the second openings 204 in the device 100. When the first attachment unit 104 is installed in the cavity 308 of the device 100, a pin rotatively connects the first attachment unit 104 to the third side 304 and fourth side 306 via the opening 204 such that an extension portion 706 extends from the lower portion 700 at an angle λ from a horizontal plane towards the trigger guard. In one embodiment, the angle λ is approximately 20 degrees. The first attachment unit 104 rotates around the pin such that the first attachment unit 110 rotates away from the trigger guard when a magazine is inserted into the device 100 and moves towards the trigger guard when the magazine is removed from the device 100. FIG. 8 depicts a front view of the first attachment device 104.

When a magazine is inserted into the cavity 308 of the device, the ejection unit 110 is rotated back to allow the magazine to pass into the receiving area of the firearm 102. The tab 500 is moved away from the trigger guard and the ejection portion 504 is pushed away from the magazine. In one embodiment, the ejection unit 110 is biased such that the ejection unit 110 engages the surface of the magazine as the magazine passes into the receiving area. The first attachment unit 104 is rotated back away from the magazine as the magazine enters the cavity 308 in the device 100. In one embodiment, the first attachment unit 104 is biased such that the first attachment unit 104 engages a side of the magazine as it passes into the receiving area of the firearm 102.

To eject the magazine from the receiving area of the gun, the tab 500 is moved towards the trigger guard and the ejection portion 504 of the ejection unit 110 is moved downward pushing the magazine out of the cavity 308 and the receiving area of the firearm 102. As the magazine is rotated out of the cavity, the first attachment unit 104 is moved downward pushing the magazine from the cavity 308.

In the present disclosure, the words "a" or "an" are to be taken to include both the singular and the plural. Conversely, any reference to plural items shall, where appropriate, include the singular.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A firearm magazine guide device for attachment to a firearm including:

a first side of the firearm magazine guide device with a 'T' shaped opening in a side of the firearm magazine guard device;

an attachment unit rotatively affixed to the firearm magazine guide device;

a magazine ejection unit rotatively affixed to a side of the firearm magazine guide device closest to a trigger guard including a rotating portion that engages the 'T' shaped opening, wherein, a portion of the magazine ejection unit is in contact with a magazine when the magazine is inserted into the firearm magazine guard device, wherein the magazine ejection unit includes an ejection portion that is configured to engage the magazine in the firearm magazine guard device and including a trigger unit connected to the ejection portion.

2. The firearm magazine guide device of claim 1 including a cavity sized to accommodate the magazine.

3. The firearm magazine guide device of claim 1 wherein the magazine ejection unit is rotatively affixed to the firearm magazine guard device by a pin.

4. The firearm magazine guide device of claim 1 including a tab unit connected to the ejection portion.

5. The firearm magazine guide device of claim 4 wherein a top surface of the tab includes a plurality of grooves.

6. The firearm magazine guide device of claim 1 including a second attachment unit is removably affixed to at least one side of a firearm.

7. The firearm magazine guide device of claim 1 including a ridge that engages a portion of a firearm near a trigger guard on the firearm.

8. The firearm magazine guide device of claim 1 wherein the ejection unit is rotatively affixed to the guard unit at a position along a length of the ejection portion.

9. The firearm magazine guide device of claim 1 wherein an end of the ejection unit is angled from a horizontal plane by a predetermined angle.

* * * * *